US009072377B2

(12) United States Patent
Beimborn

(10) Patent No.: US 9,072,377 B2
(45) Date of Patent: Jul. 7, 2015

(54) APPARATUS, SYSTEM, AND METHOD FOR SUPPORTING COMPUTER PERIPHERALS ON A CHAIR

(76) Inventor: Shayne Beimborn, Waipahu, HI (US)

( * ) Notice: Subject to any disclaimer, the term of this patent is extended or adjusted under 35 U.S.C. 154(b) by 301 days.

(21) Appl. No.: 13/366,121

(22) Filed: Feb. 3, 2012

(65) Prior Publication Data

US 2012/0200124 A1 Aug. 9, 2012

Related U.S. Application Data

(60) Provisional application No. 61/439,014, filed on Feb. 3, 2011.

(51) Int. Cl.

| | |
|---|---|
| ***A47C 7/70*** | (2006.01) |
| ***A47C 7/72*** | (2006.01) |
| ***A47B 83/02*** | (2006.01) |

(52) U.S. Cl.

CPC ..... *A47B 83/02* (2013.01); *Y10T 29/49716* (2015.01); *A47C 7/70* (2013.01); *A47C 7/72* (2013.01)

(58) Field of Classification Search

USPC ..... 297/188.12, 188.14, 188.15, 188.17, 297/188.18

See application file for complete search history.

(56) References Cited

U.S. PATENT DOCUMENTS

| | | | | | |
|---|---|---|---|---|---|
| 3,467,432 | A | * | 9/1969 | Sullivan | 297/162 |
| 3,547,488 | A | * | 12/1970 | Barnes | 297/162 |
| 4,944,552 | A | * | 7/1990 | Harris | 297/145 |
| 5,087,096 | A | * | 2/1992 | Yamazaki | 297/145 |
| 5,490,710 | A | | 2/1996 | Dearing et al. | |
| 5,612,718 | A | | 3/1997 | Bryan | |
| 5,653,499 | A | | 8/1997 | Goodall | |
| 5,683,136 | A | * | 11/1997 | Baumann et al. | 297/162 |
| 5,909,864 | A | | 6/1999 | Wang | |
| 5,931,528 | A | | 8/1999 | Shields | |
| 6,027,165 | A | * | 2/2000 | Adkins | 297/188.18 |
| 6,059,357 | A | * | 5/2000 | Peart | 297/173 |
| 6,073,997 | A | | 6/2000 | Koh | |
| 6,123,387 | A | | 9/2000 | Kelly | |
| 6,224,149 | B1 | * | 5/2001 | Gevaert | 297/162 |
| 6,264,272 | B1 | | 7/2001 | Jones et al. | |
| 6,702,373 | B2 | | 3/2004 | Rossko | |
| 6,962,311 | B1 | * | 11/2005 | Sykes | 248/118 |
| 7,017,988 | B2 | | 3/2006 | Tornero et al. | |
| 7,367,618 | B2 | * | 5/2008 | Rossini | 297/188.18 |
| 7,703,724 | B2 | | 4/2010 | Dalecki et al. | |
| 8,109,566 | B2 | * | 2/2012 | Koh | 297/145 |
| 8,267,472 | B2 | * | 9/2012 | Large et al. | 297/217.3 |
| 8,336,956 | B2 | * | 12/2012 | Westerink et al. | 297/145 |
| 8,474,384 | B2 | * | 7/2013 | Sundarrao | 108/42 |

FOREIGN PATENT DOCUMENTS

| | | | | |
|---|---|---|---|---|
| WO | WO 2008141938 | * | 12/2008 | A47C 7/72 |

* cited by examiner

*Primary Examiner* — Peter Brown
*Assistant Examiner* — Timothy J Brindley
(74) *Attorney, Agent, or Firm* — Kunzler Law Group

(57) ABSTRACT

An apparatus, system, and method are disclosed for supporting computer peripherals on a chair. An apparatus for supporting computer peripherals on a chair includes a support plate, a mounting plate, and a pivoting member. The support plate includes a substantially flat surface for supporting a computer peripheral. The mounting plate includes one or more engagement mechanisms for engaging a side of an armrest of a chair. When the mounting plate is engaged to the side of the armrest the mounting plate is oriented in a substantially vertical plane. The pivoting member couples the support plate to the mounting plate. The pivoting member permits the support plate to pivot relative to the mounting plate between a chair access mode and a peripheral usage mode.

18 Claims, 9 Drawing Sheets

APPARATUS, SYSTEM, AND METHOD FOR SUPPORTING COMPUTER PERIPHERALS ON A CHAIR

CROSS-REFERENCES TO RELATED APPLICATIONS

This application claims the benefit of U.S. Provisional Patent Application No. 61/439,014 entitled "Computer Chair Converter" and filed on 3 Feb. 2011 for Shayne Beimborn, which is incorporated herein by reference.

FIELD

This invention relates to office chairs and workspaces and more particularly relates to apparatuses for supporting computer peripherals on a chair.

BACKGROUND

Conventional computer workspace and computer peripheral setup often involves a computer with various peripherals, a desk, and a chair. Common computers include a display screen such as a monitor as well as a keyboard, mouse and other peripherals. Generally, the display screen and peripherals are placed on the desk and a user may sit in the chair at the desk to view the screen and provide input to a computer using the peripherals. However, it can be difficult to obtain a comfortable and safe position for users during long term usage of peripherals supported on a desk. For example, improper positioning of arms, wrists, or other portions of the body for extended lengths of time can lead to injuries.

Attempts to solve the above problems have included a variety of approaches. One approach, for example, includes a platform connected to a desk that holds one or more peripherals. The platform may be placed at a height that may more closely reflect a comfortable height for a user. Another common approach is that a chair may have an adjustable height so that a user can position the user's body such that the top of a desk, or a peripheral platform, is at a comfortable position for typing or using a mouse. Yet another approach includes a chair which provides support for peripherals on the chair itself. For example, some chairs include keyboards that are mounted to the chair itself and are held at a location with platforms that are attached to the chair.

SUMMARY

Applicant has identified many problems with the as yet discovered chairs for supporting peripherals. For example, existing chairs with platforms or attached peripherals are not adjustable or overly difficult to adjust. Just because a peripheral or platform is attached to a chair does not mean that it will be comfortable for a user. Users may have different heights, body styles, arm lengths, or a variety of other differences that may lead to a desired adjustment of a position of a peripheral or platform. Additionally, different users may find different chairs and/or different styles of chairs more comfortable.

In the existing chairs for supporting peripherals the added platforms or peripherals often make it difficult for a chair to be used in any manner besides use with computer peripherals. For example, the platforms and/or peripherals protrude from the normal profile of a chair such that it is hard to move the chair up next to a desk close enough to do paperwork or other work at a desk or table. Additionally, the platforms or peripherals can make it difficult to get in and out of a chair. Thus, available chairs with attached platforms or peripherals are not conducive to dual use as a computer chair and as a desk chair and may be inconvenient to use. As such, users who wish to use a chair that is capable of supporting computer peripherals may be required to have two different workspaces for different types of tasks which may be prohibitive and wasteful of valuable home or office space.

Another problem with available peripheral systems is that they may not be retrofittable to existing chairs. Even if a peripheral system may be retrofitted it may require significant adjustment and/or the use of tools. For example, drills, wrenches, or other tools may be required for installation. Thus, the installation of a system may be inconvenient and beyond the ability or patience of many users.

From the foregoing discussion, it should be apparent that a need exists for an apparatus, system, and method for supporting computer peripherals on a chair. Beneficially, such an apparatus, system, and method would be easily installable, easily adjustable, and functional as a dual use chair.

The present invention has been developed in response to the present state of the art, and in particular, in response to the problems and needs in the art that have not yet been fully solved by currently available peripheral support apparatuses. Accordingly, the present invention has been developed to provide an apparatus, system, and method for supporting computer peripherals on a chair that overcome many or all of the above-discussed shortcomings in the art.

An apparatus, system, and method are disclosed for supporting computer peripherals on a chair. An apparatus includes a support plate, a mounting plate, and a pivoting member. The support plate includes a substantially flat surface for supporting a computer peripheral. The mounting plate includes one or more engagement mechanisms for engaging a side of an armrest of a chair. When the mounting plate is engaged to the side of the armrest the mounting plate is oriented in a substantially vertical plane. The pivoting member couples the support plate to the mounting plate. The pivoting member permits the support plate to pivot relative to the mounting plate between a chair access mode and a peripheral usage mode.

In one embodiment, the support plate extends laterally in a direction substantially perpendicular to the mounting plate in the peripheral usage mode. In a further embodiment, the support plate is substantially parallel to the mounting plate in the chair access mode. In another embodiment, when the mounting plate is engaged to the side of an armrest of a chair, the support plate at least partially blocks access to a seat portion of the chair in the peripheral usage mode and the support plate allows access to the seat portion of the chair in the chair access mode.

In an additional embodiment, the apparatus includes a sliding member that permits the support plate to slide relative to the mounting plate while maintaining the support plate in a peripheral usage mode. In a further embodiment, the apparatus includes a locking mechanism for limiting sliding of the mounting plate relative to the support plate. In one embodiment, the sliding member is disposed within a channel defined by one or more protrusions from the mounting plate.

In a further embodiment, the engagement mechanisms comprise a plurality of holes in the mounting plate. In one embodiment, the plurality of holes are arranged to enable at least four points of attachment to a variety of armrests. In yet another embodiment, the pivoting member includes a hinge.

In one embodiment, the support plate comprises a raised feature near a rear edge of the substantially flat surface. In one embodiment, the support plate comprises a side pocket. In one embodiment, the support plate is adjustable between the chair access mode and the peripheral usage mode in a single pivot motion. In one embodiment, the apparatus further includes a holster.

A system of the present invention is also presented. In particular, the system, in one embodiment, includes a chair and a peripheral support apparatus. The peripheral support apparatus may include any of the above features as discussed above. In one embodiment, chair includes an armrest and the peripheral support apparatus is mounted on the armrest. In another embodiment, the mounting plate is oriented in a substantially vertical plane. In one embodiment, the pivoting member permits the support plate to pivot relative to the mounting plate between a chair access mode and a peripheral usage mode. The system may further include another peripheral support apparatus mounted to another armrest of the chair.

A method of the present invention is also presented for supporting computer peripherals on a chair. In one embodiment, the method includes providing a peripheral support apparatus. The peripheral support apparatus may include any of the variations or features as discussed herein. The method also may include mounting the peripheral support apparatus to an armrest of a chair, wherein mounting plate is oriented in a substantially vertical plane In a further embodiment, mounting the peripheral support apparatus includes mounting the peripheral support apparatus by hand without tools. In another embodiment, the method may include pivoting the support plate between a chair access mode and a peripheral usage mode.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
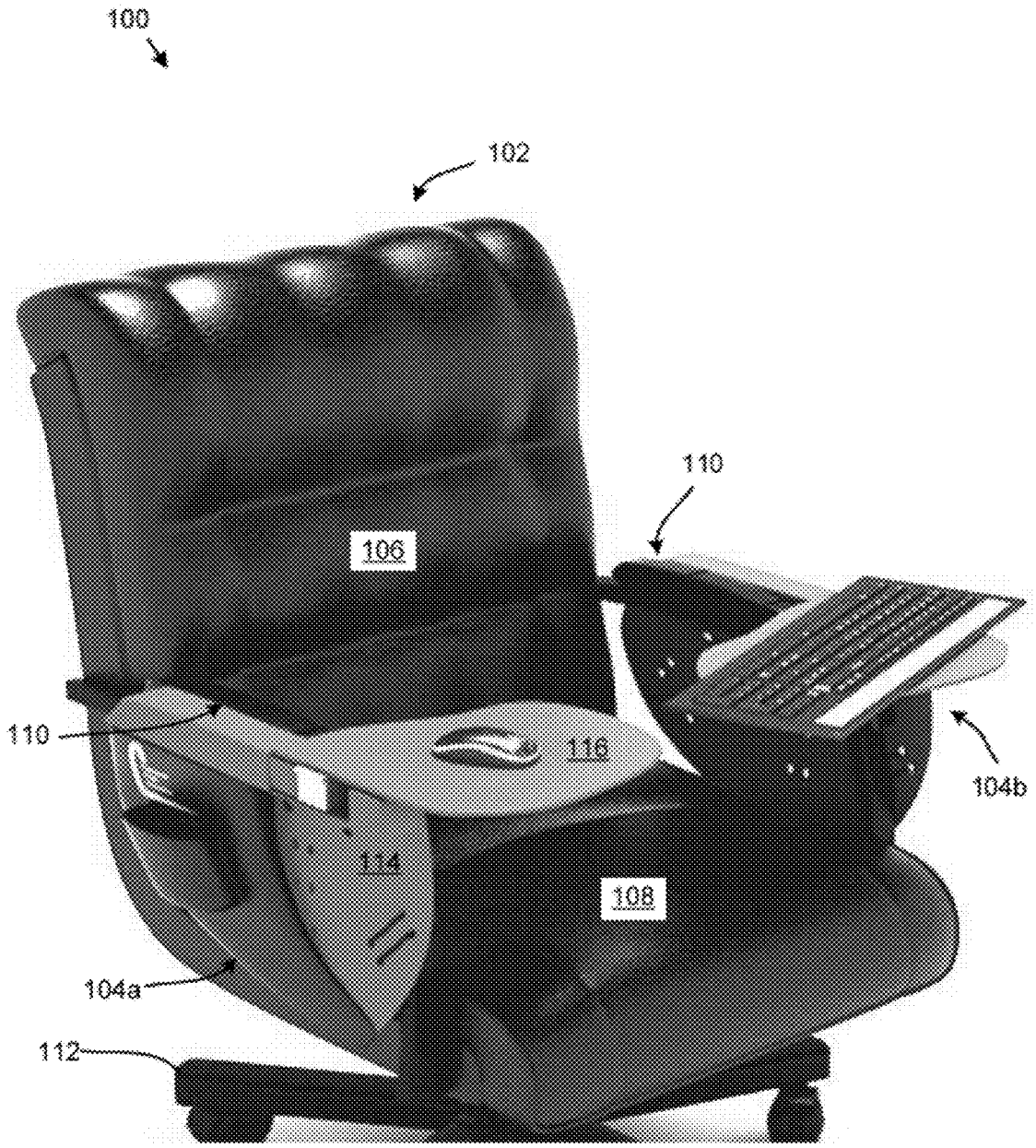
FIG. 1 is a perspective view illustrating one embodiment of a computer chair system in accordance with the present invention.

FIG. 1 is a perspective view of one embodiment of a computer chair system 100 for supporting computer peripherals. The computer chair system includes a chair 102 and peripheral support apparatuses 104*a*, 104*b*. The chair 102 includes a backrest 106, a seat 108 and two armrests 110. The seat 108 is supported by a chair stand 112 having mounted wheels. The peripheral support apparatus 104*a* includes a mounting plate 114 and a support plate 116. The peripheral support apparatus 104*a* is shown mounted via the mounting plate 114 on an armrest 110 of the chair 102. The support plates 116 are shown supporting a mouse and a keyboard.

Figure 2A:
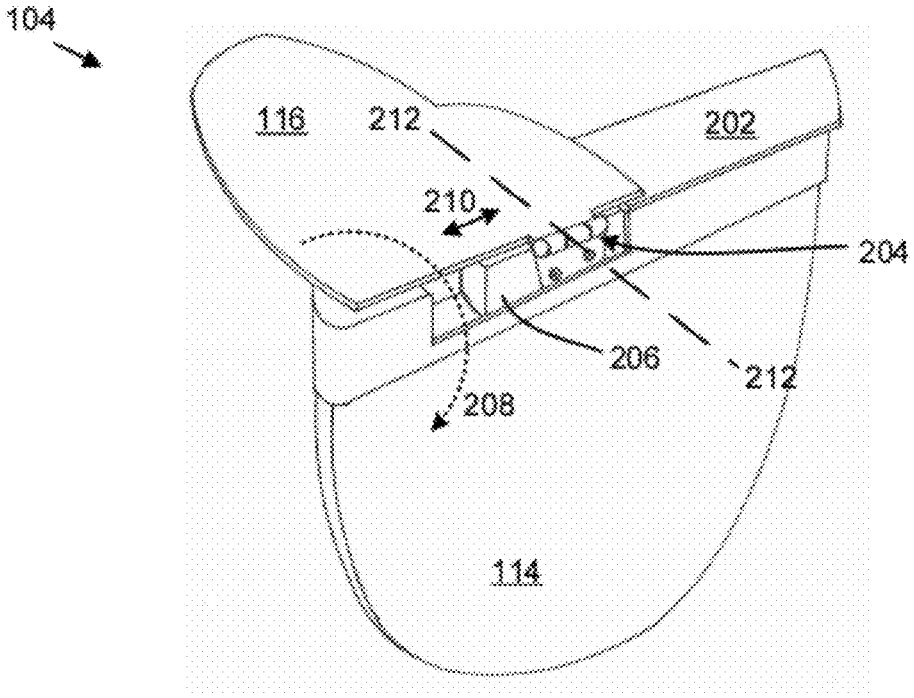
FIG. 2A illustrates one embodiment of a peripheral support apparatus in a peripheral usage mode in accordance with the present invention.
Figure 2B:
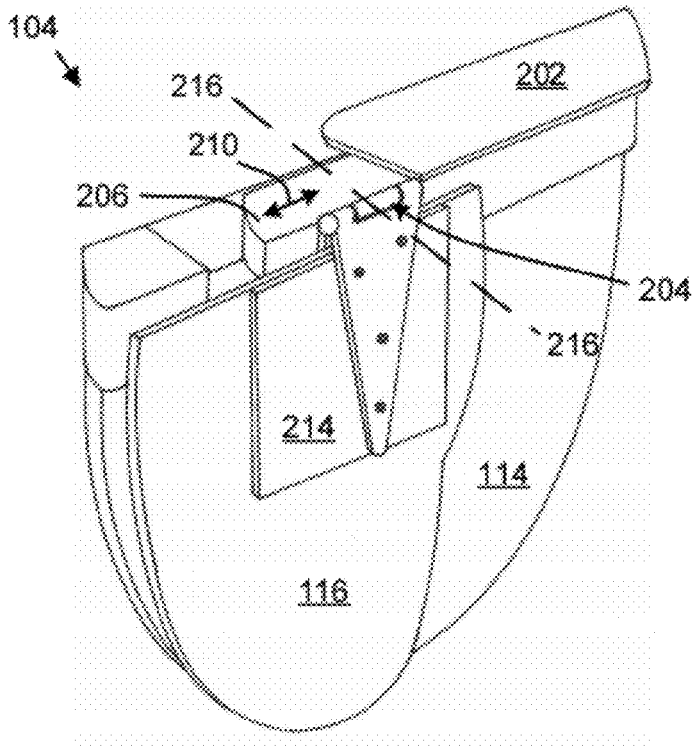
FIG. 2B illustrates one embodiment of a peripheral support apparatus in a chair access in accordance with the present invention.

FIGS. 2A and 2B are perspective views of one embodiment of a peripheral support apparatus 104. FIG. 2A illustrates a peripheral support apparatus 104 in a peripheral support mode. FIG. 2B illustrates the peripheral support apparatus in a chair access mode. The peripheral support apparatus 104 is shown free from a chair for simplicity.

The peripheral support apparatus 104 includes a mounting plate 114, a support plate 116, a top cover 202, a pivoting member 204, and a sliding member 206. In one embodiment, the mounting plate 114 is a substantially flat planar member. The mounting plate 114 may be configured to be oriented in an approximately vertical plane when mounted to a side of an armrest 110 of a chair 102. For example, the mounting plate 114 in FIG. 1 is illustrated mounted to the chair 102 and is oriented in a substantially vertical position. Depending on the configuration of an armrest 110 or a chair 102 the orientation of the mounting plate 114 may vary to different extents from being exactly vertical.

In one embodiment, the mounting plate 114 may include one or more engagement mechanisms (not shown) for engaging an armrest of a chair. The engagement mechanisms may include any type of attachment or engagement mechanism known in the art. For example, the engagement mechanisms may include holes through the mounting plate 114, one or more straps, zip ties, bolts, nuts, or the like. The engagement mechanisms may be configured to maintain the mounting plate 114 up against a side of an armrest 110 and may help provide support for other portions of the peripheral support apparatus 104. For example, the engagement mechanisms together with the mounting plate 114 and the armrest 110 may provide support for the support plate 116, a top cover 202, a pivoting member 204, and a sliding member 206.

The mounting plate 114 may be formed from a variety of materials. In one embodiment, the mounting plate 114 is formed from a substantially rigid material such as a metal, wood, plastic, or the like. In one embodiment, the mounting plate 114 is formed of a material sufficiently strong to support other portions of the peripheral support apparatus 104 as well as a computer peripheral and/or a hand, wrist, or arm of a user with respect to an armrest 110 and/or chair 102. In one embodiment, the mounting plate 114 may include a color or textured finish. For example, the mounting plate 114 may have a color or finish to match or compliment a corresponding chair 102.

The support plate 116 may also be a substantially flat planar member. The support plate 116 may include a substantially flat surface for supporting a computer peripheral. For example, the support plate 116 may include a surface substantially flat enough to allow a keyboard, mouse, or other computer peripheral to be firmly and/or levelly supported on the support plate 116. The flat surface of the support plate 116 may have a variety of textures or finishes and be formed of a variety of materials. For example, the flat surface may include a smooth and hard surface such as a wood surface, a plastic surface, a metal surface, or the like.

In one embodiment, the flat surface may include a semi soft surface such as a soft or compressible surface found on some computer mouse pads. The flat surface may have a cloth, rubber, or a textured surface, in some embodiments. For example, a non-slip rubber, cloth, or textured surface may reduce the chance of a computer peripheral slipping from the flat surface off of the support plate 116 and/or may improve operation of a corresponding peripheral. On the other hand, a smooth hard surface may allow a computer peripheral to be more easily slid around and or positioned on the support plate 116.

In one embodiment, the support plate 116 may include a raised edge or feature near an edge of the flat surface. The raised edge or feature may limit a computer peripheral from being able to slide off of the flat surface of the support plate 116. This may especially be desirable with a smooth hard finish on the flat surface or if the chair 102 is able to tilt or recline. For example, a ridge or lip near an edge of the support plate 116 on the same side of the support plate 116 as the flat surface may hinder a mouse from sliding off a support plate 116 when a user leans back in a chair. In one embodiment, the raised edge or feature may be positioned on an edge of the support plate 116 corresponding to a direction in which a chair 102 may be tilted. For example, if the chair 102 tilts backwards the raised feature may be positioned on an edge of the support plate 116 nearest to the rear of a chair 102.

In one embodiment, the support plate 116 is coupled to the mounting plate 114 via one or more members. In one embodiment, the support plate 116 is coupled to the mounting plate 114 via a pivoting member 204 which allows the support plate 116 to pivot relative to the mounting plate 114. The pivoting member 204 may include one or more hinges, joints, pivots, or the like. In the embodiment depicted in FIGS. 2A and 2B the pivoting member 204 includes a hinge. In one embodiment, the pivoting member 204 allows the support plate 116 to pivot as indicated by the arrow 208. According to one embodiment, only the single pivoting motion indicated by arrow 208 or its reverse, and no further pivoting motions, are required to place the support plate 116 in a desired mode. The support plate 116 may be pivotable between the position depicted in FIG. 2A to place the peripheral support apparatus 104 in a peripheral support mode and the position depicted in FIG. 2B to place the peripheral support apparatus 104 in a chair access mode.

In one embodiment, the support plate 116 is coupled to the pivoting member 204 via a connecting plate 214. The connecting plate 214 may provide additional support or thickness to provide a secure coupling between the pivoting member 204 and the support plate 116.

In one embodiment, the support plate 116 is coupled to the mounting plate 114 via a sliding member 206. In one embodiment, the support plate 116 engages the pivoting member 204 which engages the sliding member 206, and the sliding member 206 engages a portion of the mounting plate 114. The sliding member 206 may allow the support plate 116 to slide relative to the mounting plate 114 in the direction indicated by arrow 210. The sliding member 206 may permit the support plate 116 to slide relative to the mounting plate 114 while maintaining the support plate 116 in a peripheral usage mode, or another mode. In one embodiment, the sliding member 206 may be fixed relative to the support plate 116 and slidable relative to the mounting plate 114. For example, the sliding member 206 may fixedly engage the pivoting member 204 which fixedly engages the support plate 116. In another embodiment, the sliding member 206 may be fixed relative to the mounting plate 114 and slidable relative to the support plate 116. In one embodiment, the pivoting member 204 and the sliding member 206 may be at least partially included in the same member.

In the depicted embodiment, the sliding member 206 is shown disposed within a channel formed on the mounting plate 114. In one embodiment, the channel has a length greater than that of the sliding member 206 which may allow the sliding member 206 to remain within the channel and slide relative to the mounting plate 114. In one embodiment, the top cover 202 may serve to at least partially cover the channel where the sliding member 206 is located. In one embodiment, the top cover 202 helps secure the sliding member 206 within the channel such that the support plate 116 is maintained coupled to the mounting plate 114.

In one embodiment, the top cover 202 may serve as a surface where a users arm may be rested. For example, the top cover 202 may act as an armrest and may be disposed over or next to an armrest of a chair. In one embodiment, the top cover 202 may serve to provide an additional lateral area where a user may rest the user's arms or elbows. The top cover 202 may be formed of a variety of materials and may be formed to match other materials of the peripheral support apparatus 104. In one embodiment, the top cover 202 may include padding on a top surface to provide a comfortable surface to support an arm of a user.

Figure 3A:
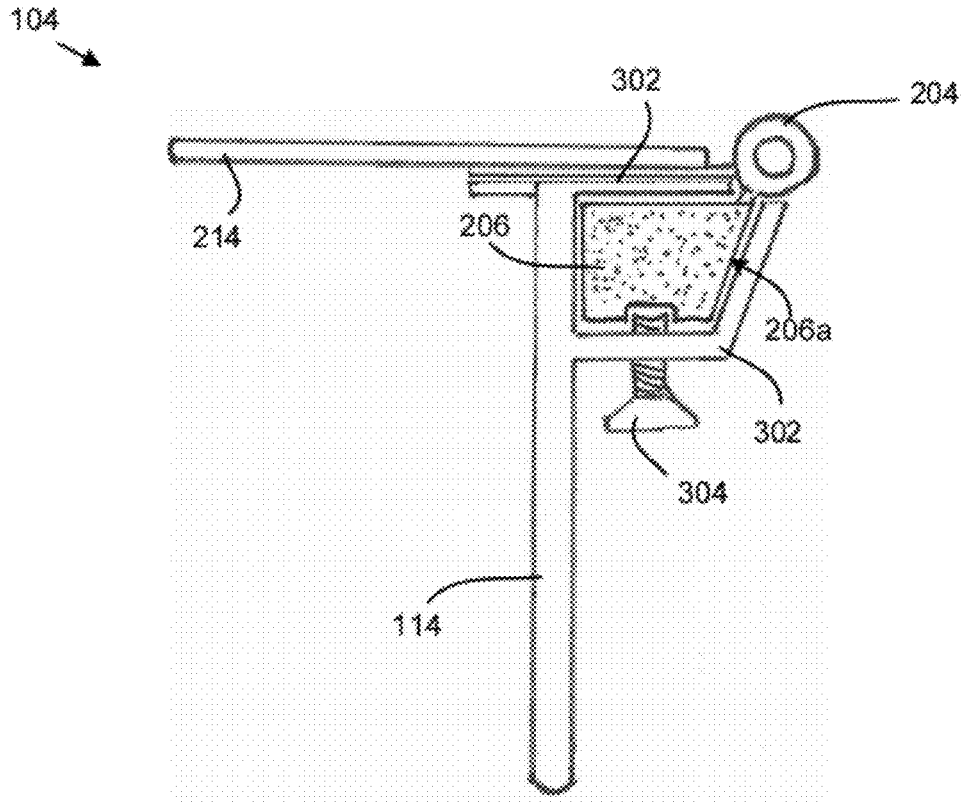
FIG. 3A illustrates a cross-sectional view of the peripheral support apparatus of FIG. 2A in a peripheral usage mode in accordance with the present invention.
Figure 3B:
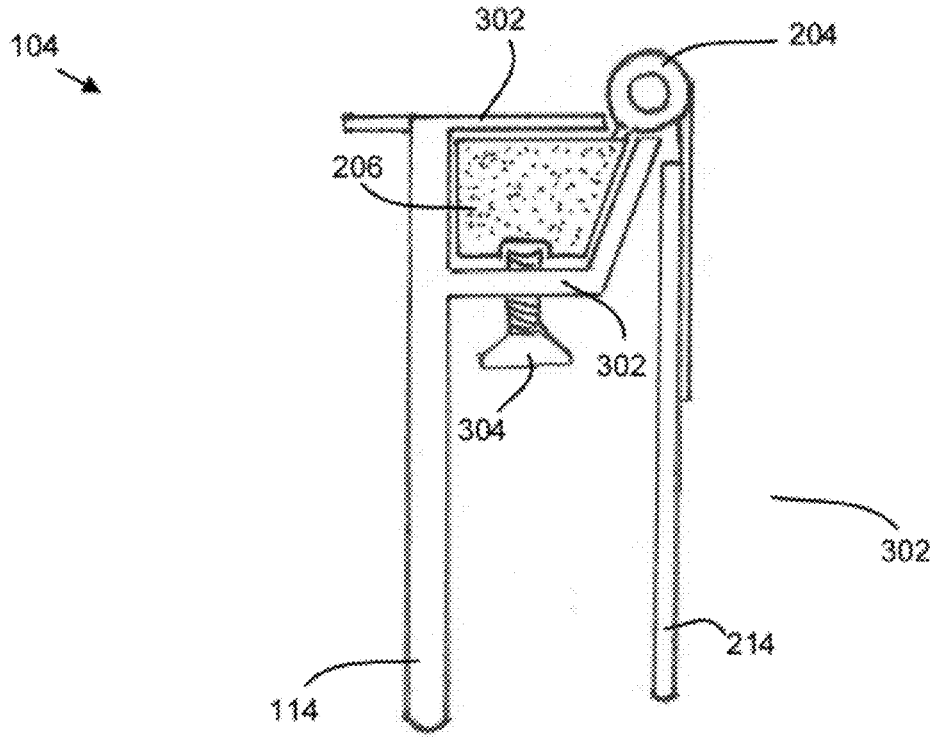
FIG. 3B illustrates a cross-sectional view of the peripheral support apparatus of FIG. 2B in a chair access mode in accordance with the present invention.

FIGS. 3A and 3B are cross-sectional views of the peripheral support apparatus 104 of FIGS. 2A and 2B. FIG. 3A illustrates a cross-sectional view of the peripheral support apparatus 104 in a peripheral support mode taken along line 212 of FIG. 2A. In one embodiment, the support plate 116 extends laterally in a direction substantially perpendicular to the mounting plate 114 when in the peripheral usage mode. FIG. 3B illustrates a cross-sectional view of the peripheral support apparatus 104 in a chair access mode taken along line 216 of FIG. 2B. FIGS. 3A and 3B illustrate the support plate 116, pivoting member 204, sliding member 206, and connecting plate 214. In one embodiment, the support plate 116 is substantially parallel to the mounting plate 114 when in the chair access mode.

In one embodiment, the sliding member 206 is positioned within a channel defined by the mounting plate 114 and protrusions 302. According to one embodiment, the sliding member 206 is at least partially retained within the channel by the protrusions 302 and is thereby coupled to the mounting plate 114. In one embodiment, the pivoting member 204 is coupled to the sliding member 206. In one embodiment, the pivoting member 204 is coupled to the sliding member 206 with screws, bolts, or other fasteners. In one embodiment, the pivoting member 204 and sliding member 206 are integrally formed. For example, at least a portion of the pivoting member 204 and the sliding member 206 may be integrally formed through a molding, welding, or other process.

In the depicted embodiment, the channel and sliding member 206 have substantially corresponding cross-sectional shapes. In other word, the external cross-sectional shape of the sliding member 206 corresponds to the internal cross-sectional shape of the channel defined by the mounting plate 114 and protrusions 302. In one embodiment, the sliding member 206 has a polygonal cross-sectional shape and the channel has a corresponding polygonal cross-sectional shape.

In the depicted embodiment, the sliding member 206 has an angled side 206*a* such that the angled side 206*a* and the connecting plate 214 (or a support plate 116) forms an angle greater than zero when the peripheral support apparatus 104 is in a chair access mode. For example, FIG. 3B illustrates the peripheral support apparatus 104 in a chair access mode with the connecting plate 214 substantially parallel to the mounting plate 114. The angle formed between angled side 206*a* and the connecting plate 214 is greater than zero. In some embodiments, this allows the connecting plate 214 and/or support plate 116 to hang in a chair access mode without contacting the mounting plate 114 or the protrusions 302.

In one embodiment, the sliding member 206 may have a circular or other non-polygonal cross-sectional shape. For example, the sliding member 206 may include a rod having a circular cross-section and may be coupled to the mounting plate 114 via one or more connectors.

Also depicted in FIGS. 3A and 3B is a locking mechanism 304. The locking mechanism 304 may be used to lock the sliding member 206 in place such that the sliding member 206 is limited from sliding relative to a mounting plate 114. In one embodiment, this may also make the support plate 116 not slidable in relation to the mounting plate 114. In the depicted embodiment, the locking mechanism 304 includes a threaded bolt or screw which can be tightened or loosened to lock or release the sliding member 206. In one embodiment, the locking mechanism 304 is adjustable by hand. In one embodiment, the locking mechanism 304 may include any bold, screw, lever, or other mechanism for locking the sliding member 206 in place.

Figure 4A:
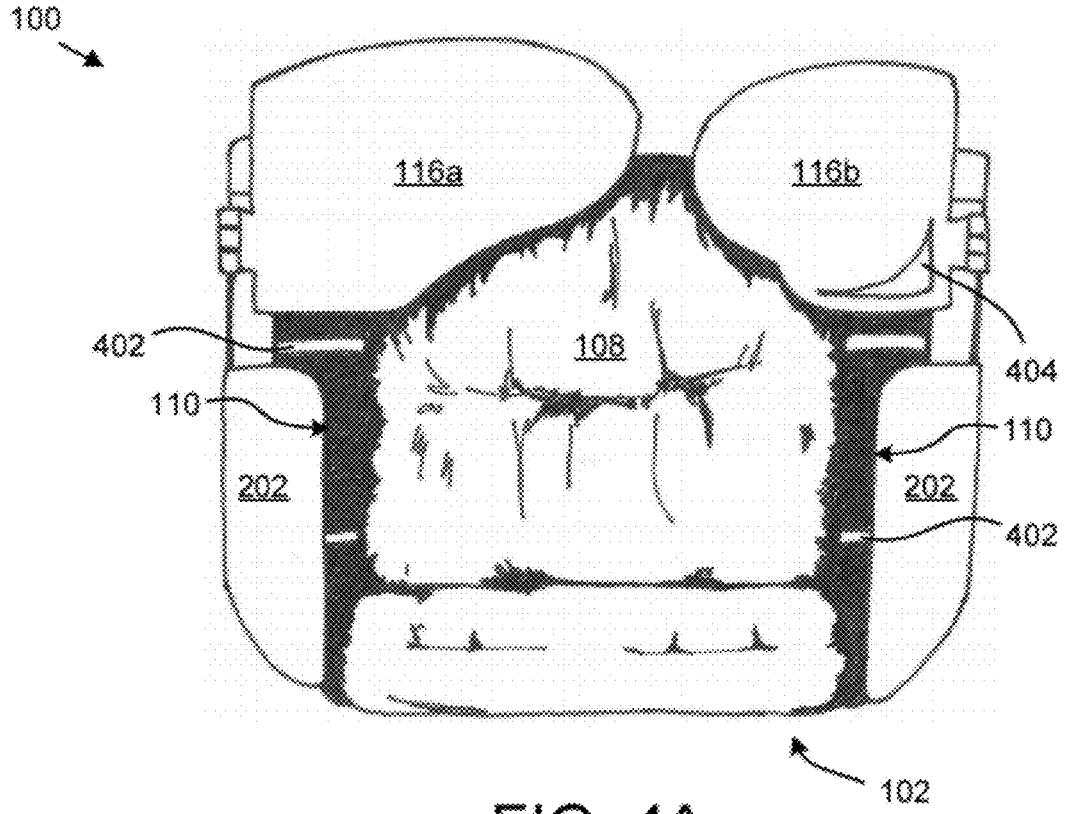
FIG. 4A illustrates a top view of the chair system of FIG. 1 with the peripheral support apparatuses in a peripheral usage mode in accordance with the present invention.
Figure 4B:
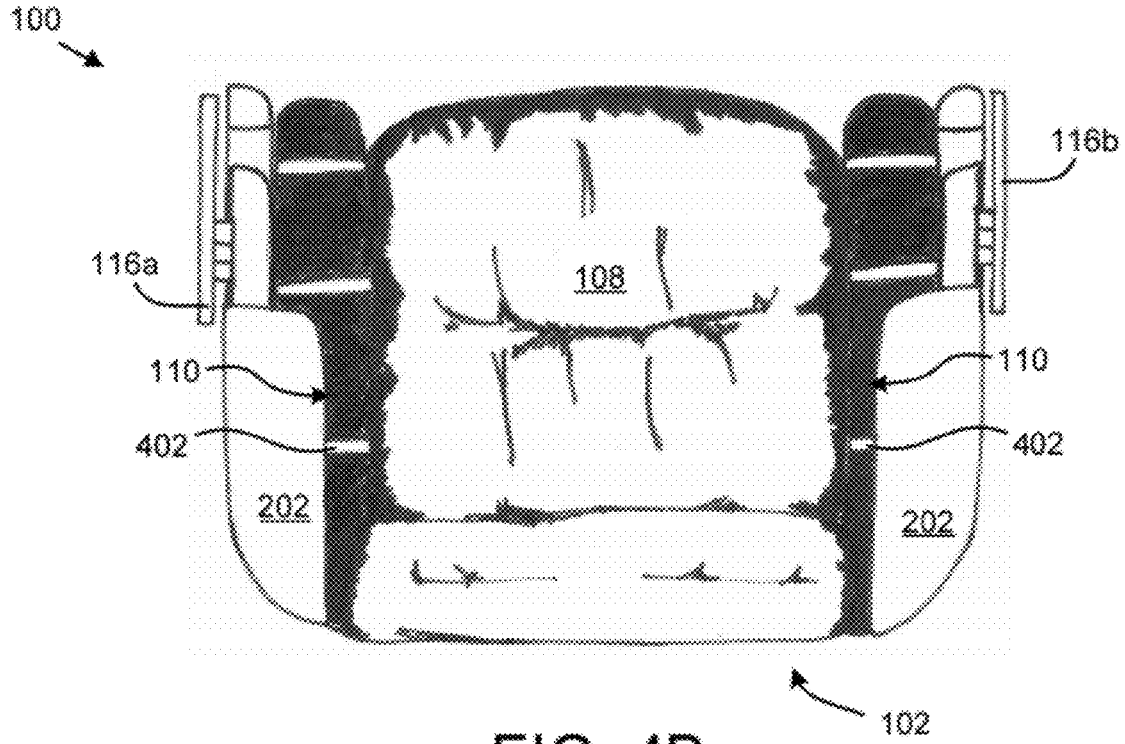
FIG. 4B illustrates a top view of the chair system of FIG. 1 with the peripheral support apparatuses in a chair access mode in accordance with the present invention.

FIGS. 4A and 4B are top views of a chair system 100 illustrating peripheral support apparatuses 104 in different modes. FIG. 4A illustrates the peripheral support apparatuses in a peripheral support mode while FIG. 4B illustrates the peripheral support apparatuses 104 in a chair access mode. The chair system 100 includes a chair 102 having a seat 108 and armrests 110 as well as a peripheral support apparatuses 104 mounted on each armrest 110. Straps 402 are shown coupling the peripheral support apparatuses 104 the armrests 110.

In FIG. 4A the support plates 116*a* and 116*b* of the peripheral support apparatuses 104 are shown in peripheral support modes. In one embodiment, the support plates 116*a* and 116*b* at least partially blocks access to a seat 108 of the chair 102. The surfaces of the support plates 116*a* and 116*b* are shown in a horizontal position and are available for supporting a peripheral. In one embodiment, the support plates 116*a* and 116*b* are of different sizes and configured for supporting different types of peripherals. For example, support plate 116*a* may be configured to support a computer keyboard and may be larger than support plate 116*b* which may be configured to support a mouse. In one embodiment, a support plate 116*b* which may be used for supporting a mouse or other peripheral may include a raised feature 404 for keeping a peripheral from sliding from the support plate 116. For example, many chairs 102 can lean or tilt backwards. The raised feature 404 may block a mouse or other peripheral from sliding off of the support plate 116*b* when a user leans back or tilts in the chair 102.

In FIG. 4B the support plates 116*a* and 116*b* of the peripheral support apparatuses 104 are shown in chair access modes. In one embodiment, the support plates 116*a* and 116*b* do not block access to the seat 108. The support plates 116*a* and 116*b* are shown collapsed at the sides of the chair 102 and do not block access to the seat 108 of the chair 102. This may allow a user to enter and exit the chair.

According to one embodiment, the peripheral support apparatuses 104 configurable between chair access modes and peripheral support modes allows for easy access and use of the chair system 100. A user may sit down in the chair system 100 when the peripheral support apparatuses 104 are in chair access modes. After sitting, the user may pivot the support plates 116*a*, 116*b* to peripheral support modes and may begin using the chair as a peripheral support while using a computer. The user may also collapse the peripheral support apparatuses 104 to the chair access mode to use the chair system 100 next to a desk. For example, the user may desire to slide the chair up to a sitting area of a desk and do some reading or paperwork.

According to one embodiment, exemplary chair system 100 peripheral support apparatuses 104 may allow for duel use. For example, the chair system 100 may function equally well for use similar to conventional chair usage as well as for supporting peripherals or providing working surfaces supported by a chair 102. This may allow a user to use the chair for multiple purposes and thus limit the number of chairs needed for different tasks.

In one embodiment, the exemplary chair system 100 may be used with or without a conventional desk. For example, a large desk or table for supporting peripherals may not be needed and may minimize the amount of space needed by a user to use a computer. For example, a space in a home or an office may be more efficiently used.

The embodiments of FIGS. 1A-4B are exemplary only. In fact considerable variation is within the scope of the present disclosure. For example, the peripheral support apparatuses 104 may be built integrally into or separately from a chair 102. In one embodiment, a peripheral support apparatus 104 may be purchased separate from a chair 102 and be mounted onto the chair 102. In another embodiment, a chair may be purchased with one or more portions of a peripheral support apparatus 104 built in.

Figure 5:
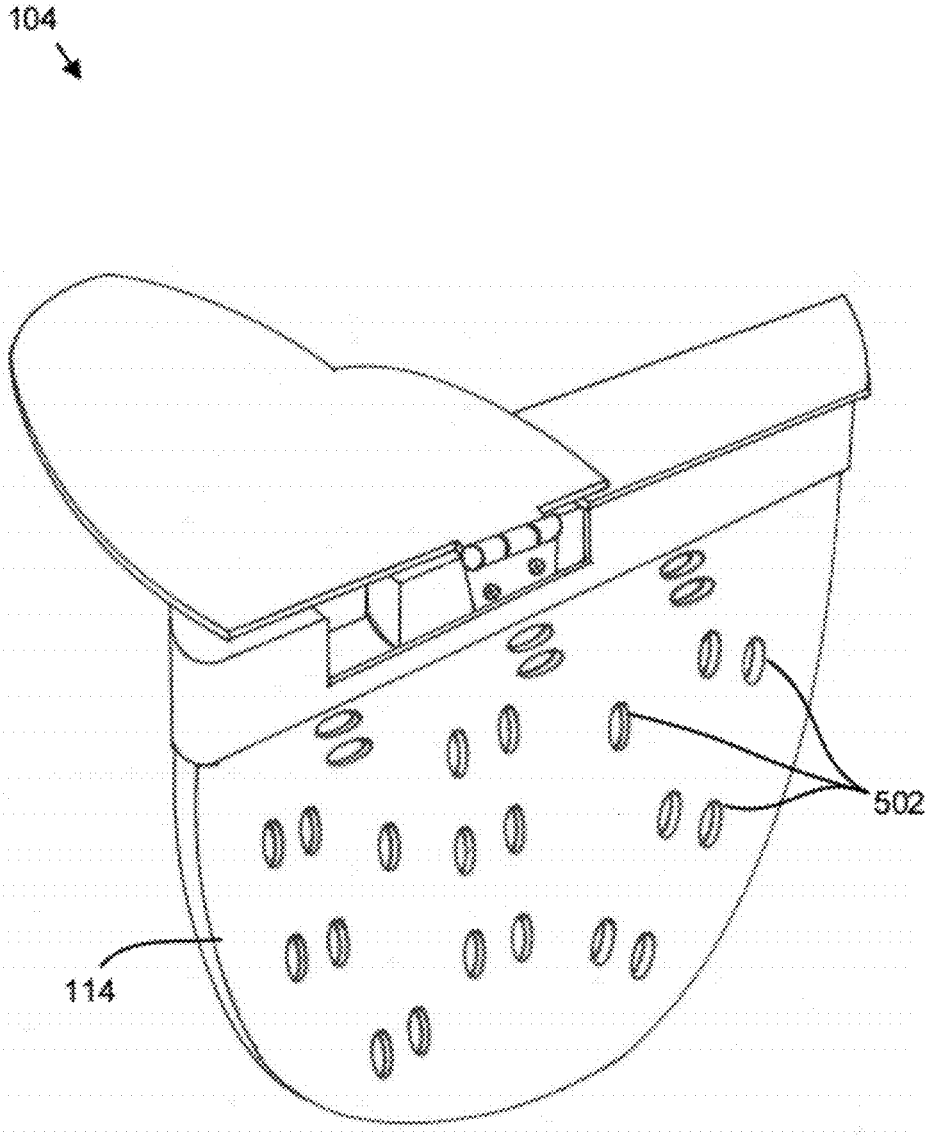
FIG. 5 illustrates a perspective view of a peripheral support apparatus with one embodiment of engagement mechanisms that include holes, in accordance with the present invention.

FIG. 5 illustrates one embodiment of on a peripheral support apparatus 104 that includes a plurality of holes 502 through the mounting plate 114. According to one embodiment, a number of the holes 502 placed to form pairs. The paired holes 502 may allow a strap or other mechanism to loop through the paired holes 502 and around a member of an armrest 110 or other portion of a chair 102 to mount the peripheral support apparatus 104 to a chair 102. For example, straps that include hook and loop fastener portions, zip ties, or the like may be used to loop through the paired holes 502 and couple the mounting plate 114 to a chair.

The holes 502 are shown in an exemplary configuration for enabling attachment to a large range of armrests 110. For example, the configuration of the holes 502 depicted in FIG. 5 may allow for mounting the peripheral support apparatus 104 to chairs having armrests of a variety of different styles such as T-shaped armrests, elliptical armrests, oval armrests, or any other armrest configuration. According to one embodiment, the hole configuration allows for four or more key points of attachment between the peripheral support apparatus 104 and a variety of different chair and/or armrest types. According to one embodiment, the hole configuration allows for at least five key points of attachment between the peripheral support apparatus 104 and a variety of different chair and/or armrest types. In one embodiment, no more than six points of attachment are needed.

Figure 6:
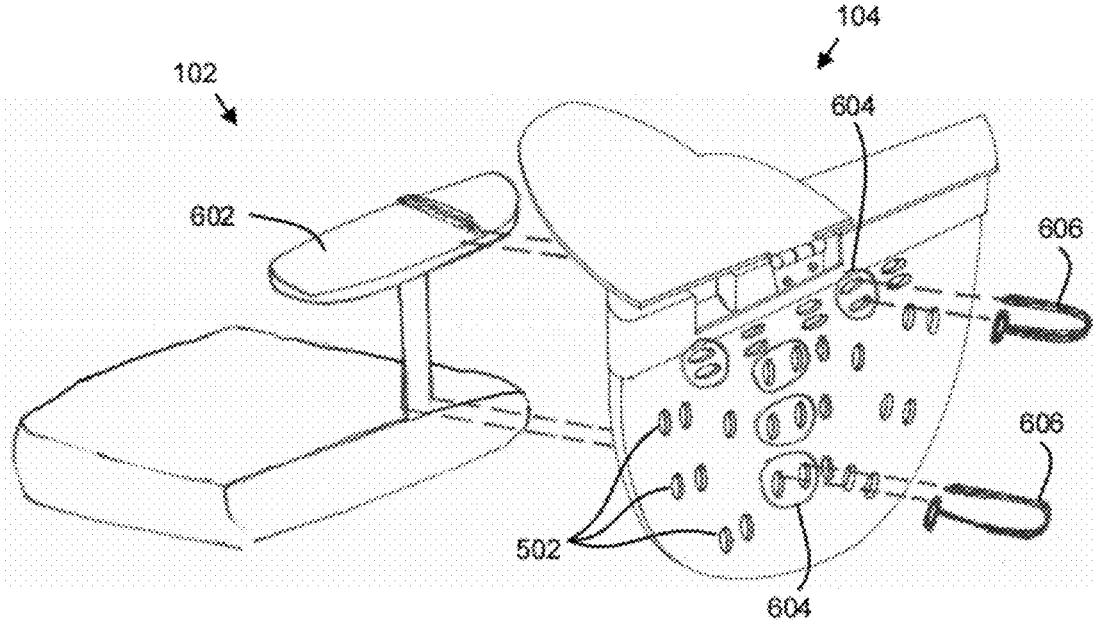
FIG. 6 illustrates a perspective assembly view of mounting a peripheral support apparatus to a T-shaped armrest, in accordance with the present invention.
Figure 7:
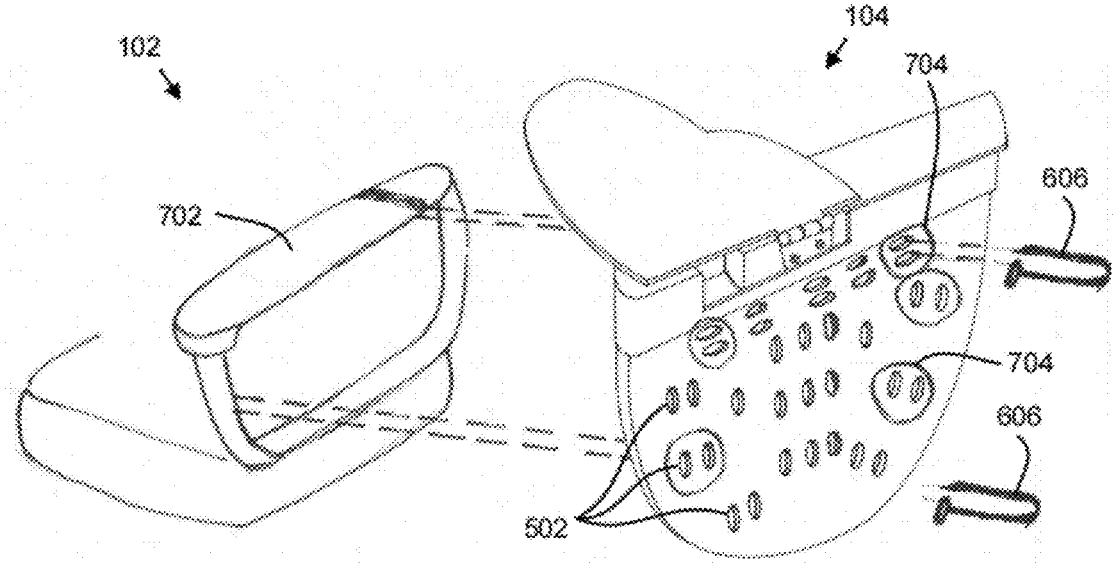
FIG. 7 illustrates a perspective assembly view of mounting a peripheral support apparatus to an elliptical armrest, in accordance with the present invention.

Turning now to FIGS. 6 and 7, exemplary mounting of a peripheral support apparatus 104 is illustrated. FIG. 6 illustrates attachment of the peripheral support apparatus 104 to one embodiment of a T-shaped armrest 602. Circled hole pairs 604 indicate locations through which straps 606 may be looped and attached to the armrest 602. As depicted, each strap 606 may run through two coupled holes. The holes through which the straps 606 run may depend on the particular armrest. The placement of the holes 502 may vary to allow the mounting plate 114 to be adjusted to position the peripheral support apparatus higher, lower, or more forward or back in position. Thus, a user can place the peripheral support apparatus 104 according to the user's preferences. It should be understood that the T-shaped armrest 602 is exemplary only. Considerable variations between T-shaped armrests are possible. In one embodiment, due to the placement of the holes 502 in the mounting plate 114 a variety of T-shaped armrests may be engaged by the peripheral support apparatus 104. FIG. 7 illustrates attachment of the peripheral support apparatus 104 to one embodiment of an elliptical armrest 702. Circled hole pairs 704 indicate locations through which straps 606 may be looped and attached to the armrest 702. Once again, the elliptical armrest 702 is exemplary only. Considerable variation between elliptical armrests is possible and may be accommodated by using different hole pairs and/or a different number of straps to connect the peripheral support apparatus 104 to an armrest.

Figure 8:
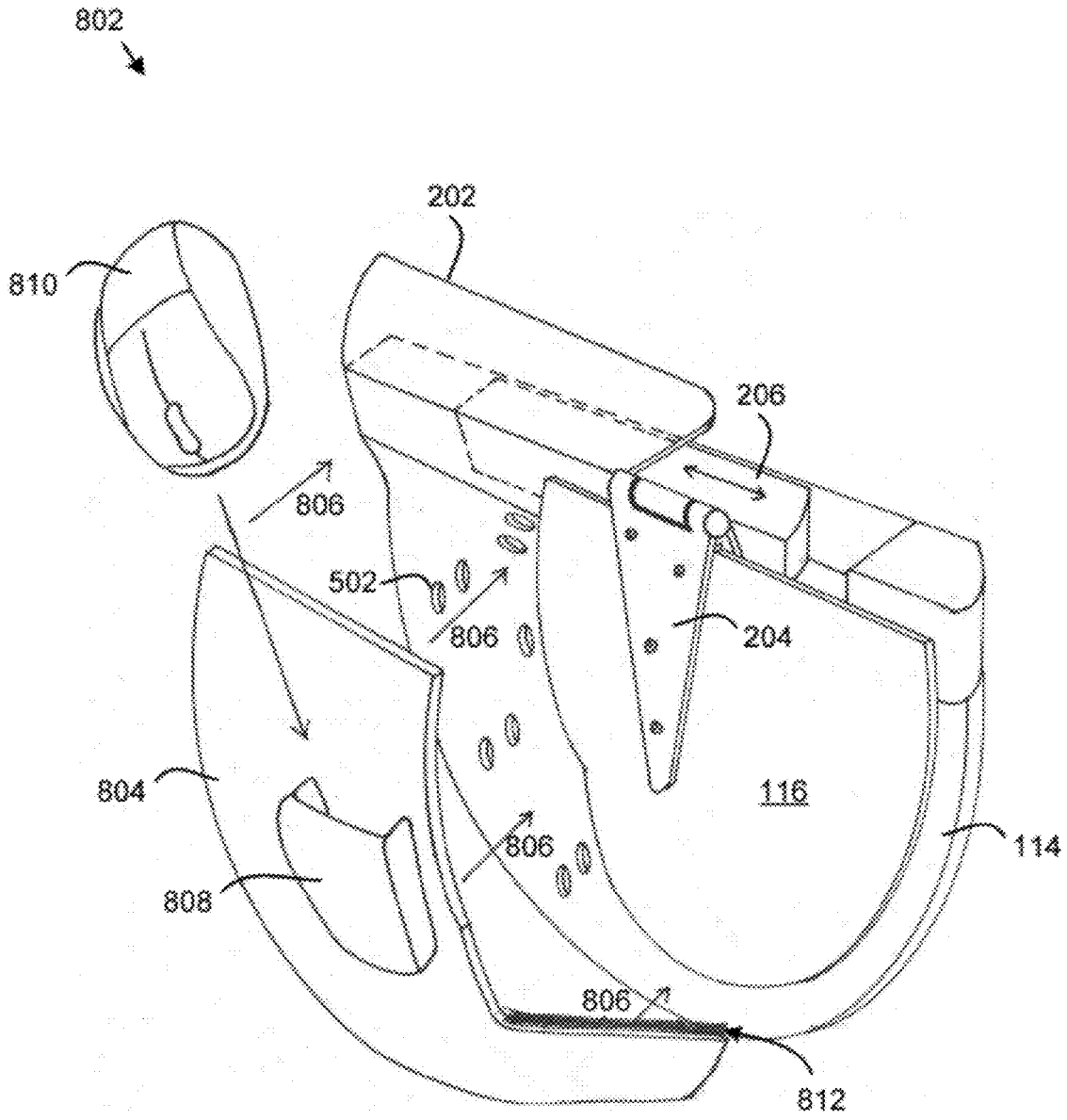
FIG. 8 illustrates a perspective assembly view of a mouse support apparatus, in accordance with the present invention.

FIG. 8 illustrates one embodiment of a mouse support apparatus 802. The mouse support apparatus 802 may be one embodiment of a peripheral support apparatus 104 and may include any of the variations discussed in relation to a peripheral support apparatus 104. For example, the mouse support apparatus 802 may include a mounting plate 114, a support plate 116, a top cover 202, a pivoting member 204, and a sliding member 206. In one embodiment, the mouse support apparatus 802 may also include side cover 804 that attaches to the mounting plate 114. One or more attachment mechanisms may be included on the side cover 804 and/or mounting plate 114 for coupling the side cover 804 to the mounting plate 114.

In one embodiment, the side cover 804 may be attached to the mounting plate 114 by pressing it against the mounting plate 114 in the direction indicated by arrows 806. The side cover 804 and/or mounting plate 114 may include one or more snap fit or press fit mechanisms which facilitate retaining the side cover 804 against the mounting plate 114. In one embodiment, the side cover 804 may serve to cover one or more engagement mechanisms such as holes 502. This may give the mouse support apparatus 802 a more desirable appearance.

In one embodiment, the side cover 804 may include a holster 808. The holster 808 may be configured to hold one or more items for convenience of a user. In one embodiment, the holster 808 is configured to receive mouse 810. For example, a user may place the mouse 810 in the holster 808 prior to manipulating the support plate 116 from a peripheral support mode to a chair access mode. Thus, even though the support plate 116 may not be available to support the mouse 810, the mouse 810 may be easily and conveniently stored in the side cover 804.

In one embodiment, the side cover 804 has an appearance, shape, and/or finish to match the support plate 116 when the support plate 116 is in a chair access mode. For example, the side cover 804 may have an edge having a shape that corresponds to a shape of an edge of the support plate 116. In one embodiment, except for a visible seam between the side cover 804 and the support plate 116 the side cover 804 and support plate 116 may appear to be formed of a single plate. In one embodiment, a receiving flap 812 may line a portion of an edge of the side cover 804 such that a seam between the side cover 804 and the support plate 116 may be covered or partially concealed. For example, the support plate 116 may tuck behind the receiving flap 812 when the support plate is in a chair access mode. Additionally, in one embodiment, the receiving flap 812 may help retain the support plate 116 in a position aligned with the side cover 804. The receiving flap 812 may be formed of a flexible material such as a soft rubber or plastic and may allow the support plate 116 to move past and be partially covered by the receiving flap 812.

Figure 9:
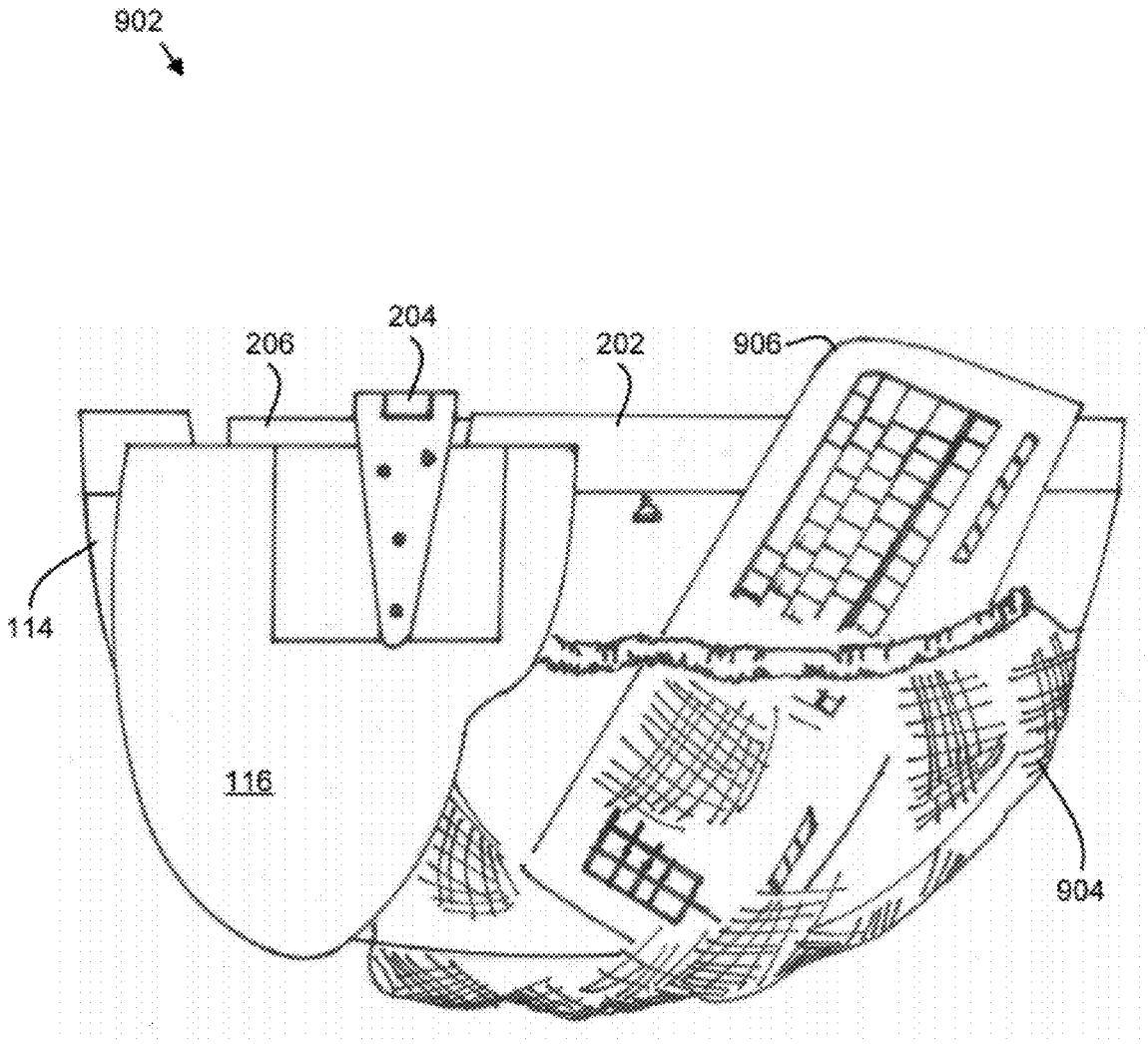
FIG. 9 illustrates a side view of a keyboard support apparatus, in accordance with the present invention.

FIG. 9 illustrates one embodiment of a keyboard support apparatus 902. The keyboard support apparatus 902 may be one embodiment of a peripheral support apparatus 104 and may include any of the variations discussed in relation to a peripheral support apparatus 104 and/or the mouse support apparatus 802. For example, the peripheral support apparatus 902 may include a mounting plate 114, a support plate 116, a top cover 202, a pivoting member 204, and/or a sliding member 206. In one embodiment, the keyboard support apparatus 902 may components the same as or similar to the side cover 804, holster 808, or receiving flap 812 of FIG. 8.

In the embodiment depicted in FIG. 9 the keyboard support apparatus 902 includes a side pocket 904. According to one embodiment, the side pocket 904 is directly connected to the mounting plate 114. According to another embodiment, the side pocket 904 is attached to a side cover which may be attached to the mounting plate 114, similar to the side cover 804 of FIG. 8.

The side pocket 904 may be configured to receive and or hold one or more items for convenient retrieval and/or placement by a user. In one embodiment, the side pocket 904 is configured to receive a keyboard 906. For example, a user may be able to place the keyboard 906 within the side pocket 904 and/or retrieve it without getting out of a chair 102. In one embodiment, if a chair system 100 includes a side pocket 904 and/or holster 808 a user may not even need an additional support surface because the chair system 100 may be able to conveniently hold peripherals even when the support platforms 116 are in chair access modes.

Figure 10:
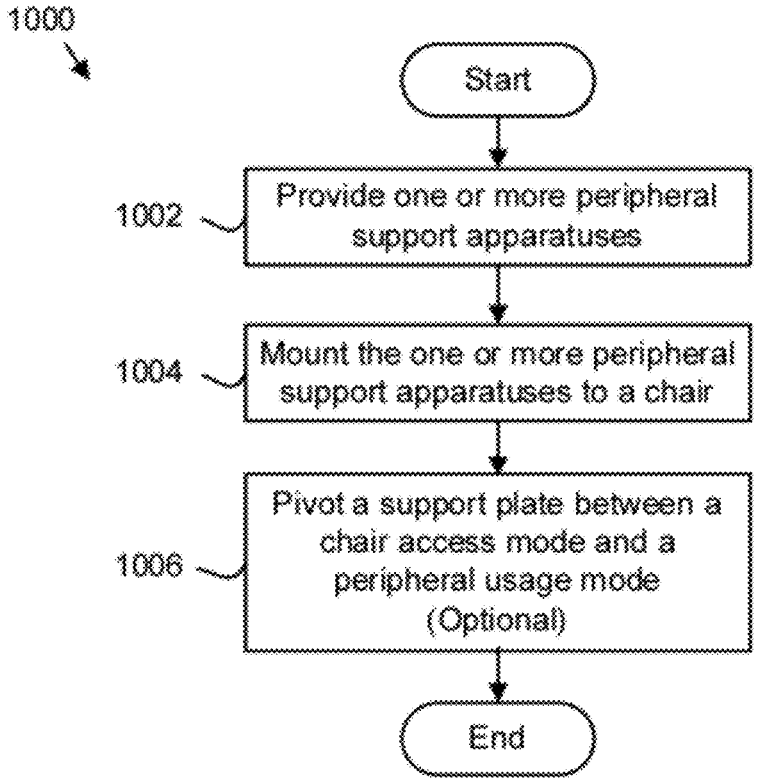
FIG. 10 is a schematic flow chart diagram illustrating one embodiment of a method for supporting a computer peripheral on a chair in accordance with the present invention.

FIG. 10 is a schematic flow chart diagram illustrating one embodiment of a method 1000 for supporting a computer peripheral on a chair. In one embodiment, a user or manufacturer may perform the method 100 when mounting a peripheral support apparatus 104 to a chair 102.

The method begins and an individual provides 1002 one or more peripheral support apparatuses 104. The provided 1002 peripheral support apparatuses 104 may include any of the embodiments, or variations disclosed in the present disclosure. In one embodiment, a peripheral support apparatus 104 includes a support plate 116, a mounting plate 114, and a pivoting member 204. A peripheral support apparatus 104 may also include a sliding member 206, top cover 202, side cover 804, or any of the other features discussed herein. In one embodiment, only a single peripheral support apparatus 104 is provided. In another embodiment, two peripheral support apparatuses 104 may be provided. For example, a mouse support apparatus 802 and a keyboard support apparatus 902 may be provided 1002.

The method includes mounting 1004 the one or more peripheral support apparatuses 104 to a chair 102. In one embodiment, each of the provided 1002 peripheral support apparatuses 104 is mounted to an armrest 110 of the chair 102. For example, a first peripheral support apparatus 104 may be mounted to a first armrest 110 while a second peripheral support apparatus 104 may be mounted to a second armrest 110. Mounting 1004 the one or more peripheral support apparatuses 104 may include mounting the mounting plate 114 to a side of an armrest of a chair 102. In one embodiment, one or more engagement mechanisms may be used to engage a side of an armrest. In one embodiment, straps may be looped through one or more holes in the mounting plate 114 and a member of a chair 102 to couple the mounting plate 114 to the chair 102.

In one embodiment, the one or more peripheral support apparatuses 104 may be mounted 1004 to the chair 102 by hand without tools. For example, the engagement mechanisms used to engage the chair may be attachable by hand. In one embodiment, no tools such as drills for creating holes or tightening screws or bolts may be needed. In one embodiment, the engagement mechanisms may include holes through the mounting plate 114 and one or more straps. The straps may include hook and loop fasteners, buttons, or any other sort of hand manipulable fastener or attachment mechanism. In one embodiment, the peripheral support apparatuses 104 are also adjustable by hand without tools.

The method may optionally include pivoting 1006 a support plate 116 between a chair access mode and a peripheral usage mode. In one embodiment, the support plate may be pivoted 1006 by hand between a chair access mode and a peripheral usage mode. For example, a user may pivot 1006 the support plate 116 about a pivoting member 204 from a position substantially parallel to a mounting plate 114 to a position substantially perpendicular to the mounting plate 114. In one embodiment, the support plate 116 may be pivoted 1006 from a chair access mode to a peripheral usage mode in a single pivoting motion. For example, it may not be required to pivot the support plate in a first direction and the pivot the support plate in a second direction to manipulate the mode.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a support plate, the support plate comprising a substantially flat surface for supporting a computer peripheral;

a sliding member, the sliding member comprising a polygonal cross-sectional shape that permits the sliding member to be disposed within a channel that has a corresponding polygonal cross-sectional shape, wherein a side of the sliding member is angled such that the angled side and the support plate form an angle greater than zero while in a chair access mode;

a pivoting member, the pivoting member coupling the support plate to the sliding member; and a mounting plate, the mounting plate comprising a plurality of engagement mechanisms for engaging a side of an armrest of a chair, the engagement mechanisms comprising a plurality of hole pairs configured to receive straps that loop through the hole pairs and attach the mounting plate to the armrest, each hole pair of the plurality of hole pairs being placed at different locations on the mounting plate to accommodate different positions on the armrest and different armrest configurations, wherein when the mounting plate is engaged to the side of the armrest the mounting plate is oriented in a substantially vertical plane, and the channel is disposed adjacent to a side of the armrest and substantially parallel with the armrest;

a top cover, the top cover securing the sliding member within a channel formed on the mounting plate when the sliding member is disposed within the channel;

wherein the sliding member couples the support plate to the mounting plate, the sliding member being disposed within the channel formed on the mounting plate, and wherein the pivoting member permits the support plate to pivot relative to the mounting plate between a chair access mode and a peripheral usage mode.

2. The apparatus of claim 1, wherein in the peripheral usage mode the support plate extends laterally in a direction substantially perpendicular to the mounting plate.

3. The apparatus of claim 1, wherein in the chair access mode the support plate is substantially parallel to the mounting plate.

4. The apparatus of claim 1, wherein when the mounting plate is engaged to the side of the armrest of the chair and when the support plate is in the peripheral usage mode, the support plate at least partially blocks access to a seat portion of the chair; and when the support plate is in the chair access mode the support plate allows access to the seat portion of the chair.

5. The apparatus of claim 1, wherein the sliding member permits the support plate to slide relative to the mounting plate while maintaining the support plate in a peripheral usage mode.

6. The apparatus of claim 5, further comprising a locking mechanism for limiting sliding of the mounting plate relative to the support plate.

7. The apparatus of claim 5, wherein the sliding member is disposed within a channel defined by one or more protrusions from the mounting plate.

8. The apparatus of claim 1, wherein the pivoting member comprises a hinge.

9. The apparatus of claim 1, wherein the support plate comprises a raised feature near a rear edge of the substantially flat surface.

10. The apparatus of claim 1, wherein the support plate comprises a keyboard support apparatus.

11. The apparatus of claim 1, wherein the mounting plate is mountable to a chair armrest by hand without tools.

12. The apparatus of claim 1, wherein the support plate is adjustable between the chair access mode and the peripheral usage mode in a single pivot motion.

13. The apparatus of claim 1, further comprising a holster.

14. A chair system comprising;

an office chair comprising an armrest; and a peripheral support apparatus comprising, a support plate, the support plate comprising a substantially flat surface for supporting a computer peripheral, a sliding member, the sliding member comprising a polygonal cross-sectional shape that permits the sliding member to be disposed within a channel that has a corresponding polygonal cross-sectional shape, wherein a side of the sliding member is angled such that the angled side and the support plate form an angle greater than zero while in a chair access mode, a pivoting member, the pivoting member coupling the support plate to the sliding member, and a mounting plate, the mounting plate comprising a plurality of engagement mechanisms for engaging a side of an armrest of the chair, the engagement mechanisms comprising a plurality of hole pairs configured to receive straps that loop through the hole pairs and attach the mounting plate to the armrest, each hole pair of the plurality of hole pairs being placed at different locations on the mounting plate to accommodate different positions on the armrest and different armrest configurations, a top cover, the top cover securing the sliding member within a channel formed on the mounting plate when the sliding member is disposed within the channel, wherein the sliding member couples the support plate to the mounting plate, the sliding member being disposed within the channel formed on the mounting plate, wherein the peripheral support apparatus is mounted on the armrest and the mounting plate is oriented in a substantially vertical plane, and the channel is disposed adjacent to a side of the armrest and substantially parallel with the armrest, and wherein the pivoting member permits the support plate to pivot relative to the mounting plate between a chair access mode and a peripheral usage mode.

15. The chair system of claim 14, wherein the peripheral support apparatus comprises a first peripheral support apparatus and the armrest comprises a first armrest, the chair system further comprises a second peripheral support apparatus mounted on a second armrest.

16. A method comprising providing a peripheral support apparatus comprising, a support plate, the support plate comprising a substantially flat surface for supporting a computer peripheral, a sliding member, the sliding member comprising a polygonal cross-sectional shape that permits the sliding member to be disposed within a channel that has a corresponding polygonal cross-sectional shape, wherein a side of the sliding member is angled such that the angled side and the support plate form an angle greater than zero while in a chair access mode, the channel is disposed adjacent and substantially parallel to the armrest, a pivoting member, the pivoting member coupling the support plate to the sliding member, and a mounting plate, the mounting plate comprising a plurality of engagement mechanisms for engaging a side of an armrest of a chair, the engagement mechanisms comprising a plurality of hole pairs configured to receive straps that loop through the hole pairs and attach the mounting plate to the armrest, each hole pair of the plurality of hole pairs being placed at different locations on the mounting plate to accommodate different positions on the armrest and different armrest configurations, a top cover, the top cover securing the sliding member within a channel formed on the mounting plate when the sliding member is disposed within the channel, wherein the sliding member couples the support plate to the mounting plate, the sliding member being disposed within the channel formed on the mounting plate, and wherein the pivot mechanism allows the support plate to pivot relative to the mounting plate between a chair access mode and a peripheral usage mode, and mounting the peripheral support apparatus to an armrest of a chair, wherein mounting plate is oriented in a substantially vertical plane, and the channel is disposed adjacent to a side of the armrest and substantially parallel with the armrest.

17. The method of claim 16, wherein mounting comprises mounting the peripheral support apparatus by hand without tools.

18. The method of claim 16, further comprising pivoting the support plate between a chair access mode and a peripheral usage mode.

* * * * *